United States Patent [19]

Pfeifer

[11] 4,395,955

[45] Aug. 2, 1983

[54] PARTIAL BANDING MEANS FOR DISPLAY SHELVES

[75] Inventor: William Pfeifer, Springdale, Pa.

[73] Assignee: Armstrong Store Fixture Corporation, Pittsburgh, Pa.

[21] Appl. No.: 205,655

[22] Filed: Nov. 10, 1980

[51] Int. Cl.[3] ..... A47B 57/28

[52] U.S. Cl. ..... 108/61; 211/184; 312/140.3

[58] Field of Search ..... 108/60, 61, 27; 312/140.1, 140.3, 140.4; 211/184

[56] References Cited

U.S. PATENT DOCUMENTS

| | | | |
|---|---|---|---|
| 712,936 | 11/1902 | Jones | 211/184 |
| 1,211,760 | 1/1917 | Rothweiler | 312/140.3 |
| 2,718,326 | 9/1955 | Le Blanc | 312/140.3 X |
| 2,988,844 | 6/1961 | Frimberger | 297/443 X |
| 3,484,226 | 12/1969 | Golightly | 211/184 X |
| 3,501,019 | 3/1970 | Armstrong et al. | 108/61 |
| 3,703,964 | 11/1972 | Field | 211/184 |
| 4,043,456 | 8/1977 | Howell | 108/61 |

*Primary Examiner*—Francis K. Zugel

*Attorney, Agent, or Firm*—Parmelee, Miller, Welsh & Kratz

[57] ABSTRACT

Merchandise display area banding members are disclosed for use in providing partial frontal banding. The banding members are made of plastic and can function individually as either a left or right handed partial banding section or in combination with each other by means of a tongue and groove configuration to form an elongated center partition partial banding section. Channels defined on both sides of the banding member engage a vertical slot in a partition and inhibit lateral movement relative thereto.

4 Claims, 5 Drawing Figures

PARTIAL BANDING MEANS FOR DISPLAY SHELVES

BACKGROUND OF THE INVENTION

1. Field of the Invention

The invention relates to display shelf banding and more particularly to a banding member which provides partial frontal banding for a display shelf.

2. Prior Art

It may be explained that recent trends in merchandising have accentuated the concepts of product visability and accessibility to the consumer. One result of these trends is the partial frontal banding of display shelves. Heretofore, it has been the general practice to provide partitions which serve as banding members arranged to form the ends and front and rear sides of a display area to keep articles from falling off the display area, or as binning members arranged diagonally or transversely across the display area to form dividers separating the area into compartments.

Partial frontal banding serves the dual purpose of protecting merchandise from falling from the display area while maximizing the consumers' access to the merchandise. Because a single display area is usually partitioned into several compartments, it has been necessary to provide at least three types of banding to achieve partial frontal banding: a right hand section, a left hand section, each of which extends in essentially one direction from a partition or end banding and a center section which extends in both directions from a partition serving as a display area divider.

It is the object of this invention to provide a banding member suited for use in partial banding. A single integrally molded member can be used as a right or left handed section or the banding member can be mated with a second member of complementary design to form an elongated banding section for use as a center banding section.

SUMMARY OF THE INVENTION

The banding member of the instant invention may be used with a vertical planar member such as a shelf partition having a vertical mounting slot therein for receiving and supporting planar banding. Preferably the banding member is molded as a clear plastic device which has a glass-like appearance. A banding section consists of a planar member with a vertical tongue and groove adjoining one edge and a pair of horizontally spaced protuberances on both sides of the planar member adjacent that edge. Each pair of protuberances defines a vertical channel which engages the vertical edge of a partition when mounted within the vertical slot. Each banding section is interchangeble, that is, it may serve as either a right or left handed section in a partially banded display.

A first banding member can be mated with a second banding member of complementary configuration by means of the tongue and groove assemblies. The mated sections may be inserted into the vertical slot of a partition serving as a divider to provide partial banding extending from both sides of the divider. The elongated banding member has a vertical channel on both sides. The channels are defined by the pairs of protuberances on the individual banding members. The channels and protuberances on a single banding member and those on an elongated section both serve to engage the vertical slot of the partition and restrict lateral movement of the banding relative to the partition. Each banding member is provided with notches at the top and bottom portion of the vertical channels which extend to the vertical edge adjacent the tongue and groove. The banding member herein disclosed can be rotated both vertically and horizontally without effecting its capacity to join with a partition.

DESCRIPTION OF THE PREFERRED EMBODIMENT

Figure 1:
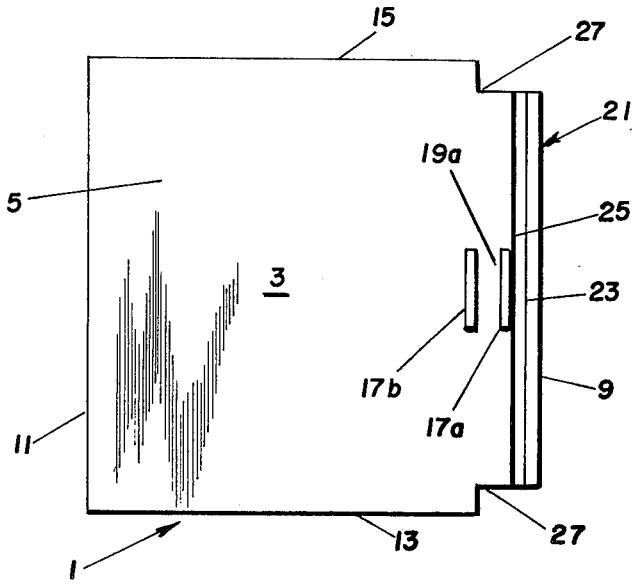
FIG. 1 is a side elevation of a banding member all in accordance with the teachings of this invention.
Figure 2:
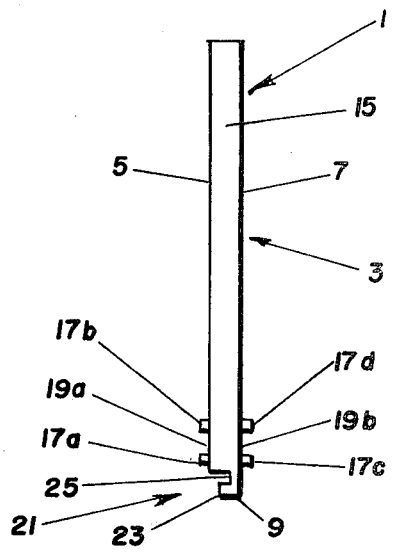
FIG. 2 is a plan view of the banding member shown in FIG. 1.

Considering both FIGS. 1 and 2, a banding member incorporating the features of this invention is indicated by the reference numeral 1. While it is possible to manufacture this device from a variety of materials, it is preferred that the banding be molded from a resin which renders a final plastic product having a glass-like appearance. The banding member 1 consists of a planar member 3 having a first face 5, a second face 7, a first vertical edge 9, a second vertical edge 11, a first horizontal edge 13 and a second horizontal edge 15. The planar member 3 also includes a first pair of protuberances 17*a* and 17*b* which define a vertical channel 19*a* on the first face 5 and a second pair of protuberances 17*c* and 17*d* on the second face 7 directly opposed to the first pair 17*a* and 17*b*. The second pair of protuberances 17*c* and 17*d*, as seen in FIG. 2, form a channel 19*b* which mirrors the vertical channel 19*a*. Preferably the individual protuberances of each pair are elongated members which are parallel to each other. Each pair is adjacent to the first vertical edge 9 of the planar member 3. A means by which two banding members may be joined to form an elongated banding member is indicated generally at 21 and consists of a tongue 23 and groove 25 along the first vertical edge 9. The tongue 23 extends along the first vertical edge 9 and then projects in the direction of, but terminates short of, the plane of the first face 5 of the banding member. The tongue 23 is approximately two-thirds the thickness of the planar member 3 and the depth of the groove 25 extends through about two-thirds of the thickness of the planar member 3. The manner in which the joining means 21 are utilized will be described hereinafter. Notches, indicated at 27 are provided at both the upper and lower edges of the first vertical edge 9. Each notch extends from the first vertical edge 9 through the channel defined by the protuberances 17*a* through 17*d*. Accordingly, the first vertical edge 9 is slightly shorter than the second vertical edge 11.

Figure 3:
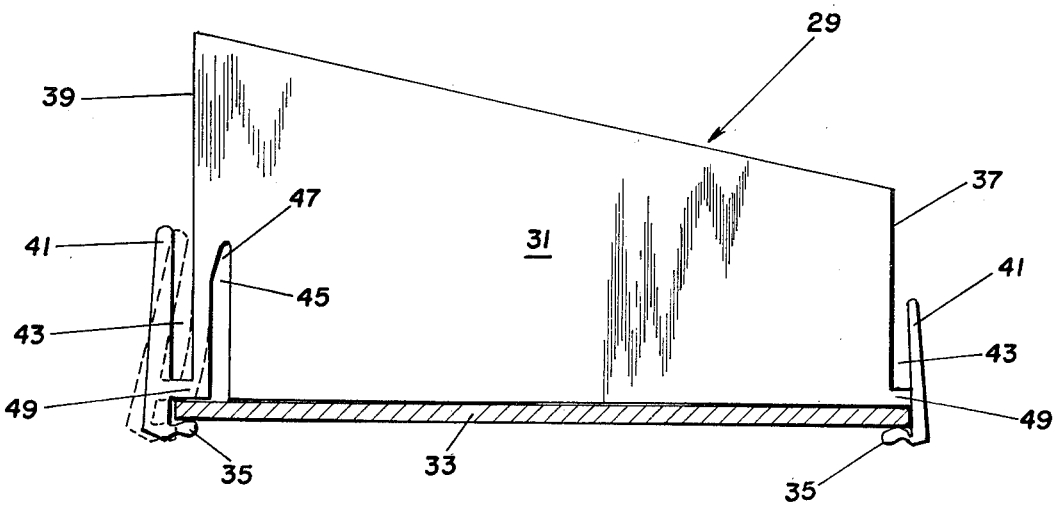
FIG. 3 is a side elevation view of a partition suitable for use with the inventive banding member.

The banding member is designed for use with a shelf partition having a vertical slot therethrough. While a variety of partitions may be utilized with the subject invention, it is preferred that the partition be manufactured from a material which renders a final product having a glass-like appearance. In FIG. 3, a partition 29 which is ideally suited for use with the banding member is illustrated. The shelf partition 29 consists of a vertical planar member 31 which includes integral means for securing the partition to the horizontal component of a display area such as the shelf 33 shown in cross section. The securing means are hooks 35 adjacent both the forward vertical edge 37 and rear vertical edge 39 of the planar member 31, depending downwardly therefrom below the bottom edge 40 of the planar member and curving inwardly toward the center of the partition 29. The inner radius of the hook is of such a diameter as to provide a firm grip of the shelf when engaged therewith. Resilient arms 41 extend upwardly from the hooks along side the vertical edges 37 and 39 slightly biased inwardly toward the same, and together with said vertical edge define vertical slots 43 for receiving and supporting at least one banding partition in an essentially pependicular relationship with the partition. To enhance the stability of the partition 29, the arms 41 may be of slightly greater thickness than the planar member 31. Accordingly, as herein illustrated, the arms 41 do not extend to match the full height of the partition in order to avoid interfering with the protuberances on the banding member.

Correspondingly, as shown in FIG. 1, the protuberances which define the vertical channel may not project along the entire height of the banding member but only occupy an area equivalent to about the center one third of the banding member. This configuration allows the protuberances on the face of the banding abutting the vertical edge 37 to straddle the planar member 31.

By defining a channel on the second face of the banding member, either face of the banding may abut the vertical edge 37. Additionally, under different circumstances, such as when the vertical slot is defined by structures of uniform thickness, the channels on both sides of the banding may engage the partition. While the channels are presently being defined in terms of pairs of protuberances, it is, of course, possible to provide a channel defined by a recess in the face of the planar member for use with a vertical slot of an appropriately adjusted width.

To facilitate the mounting of the partition 29 onto a shelf, a vertical mounting slot 45 is located along one of the vertical edges of the banding such as along the rear vertical edge 39. The width of the slot narrows as the channel approaches its upper reach as at 47. As a result, the danger of stress cracks is minimized when the hook adjacent the channel 45 is urged out away from its normal rest position in order to mount the partition onto a shelf as shown in phantom. Once positioned on the shelf, the hook returns to its rest position and secures the partition to the shelf.

It is to be understood that the instant banding member may be used with partitions having any of a variety of securing means other than the hooks 35. It is only necessary that the partition be equipped with a vertical slot having a width corresponding to the thickness of the banding member 1.

Figure 4:
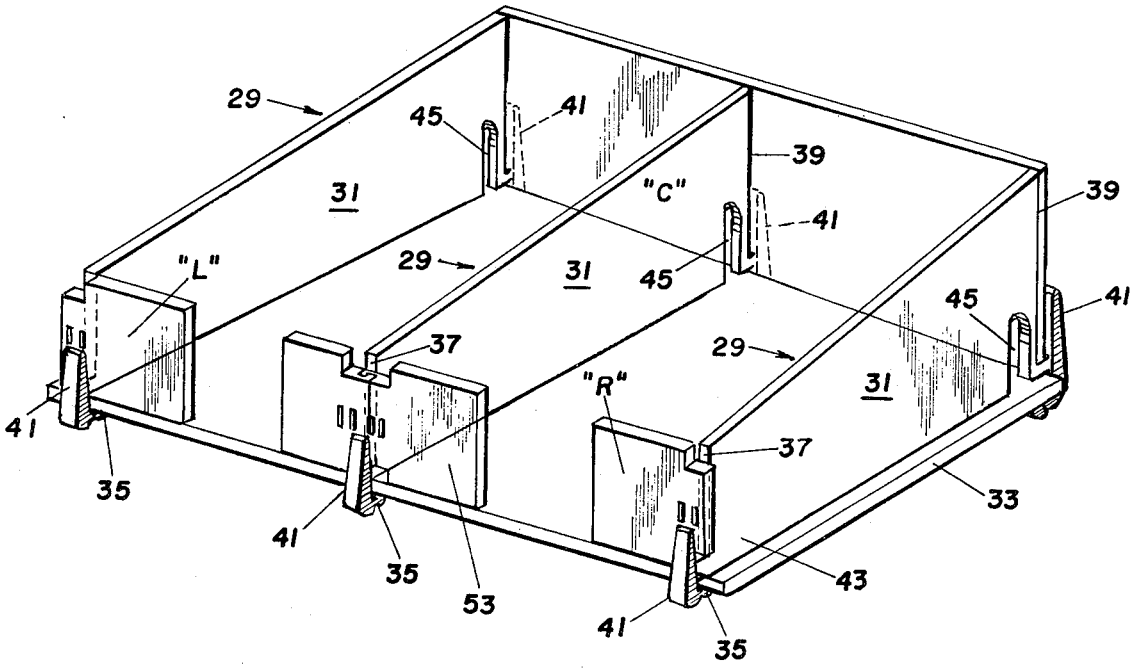
FIG. 4 is an isometric view of the banding of FIG. 1 and the partition of FIG. 3 mounted on a shelf.

Turning to FIG. 4, the instant banding member 1 can be used as either a left L or R handed section of banding. A banding member 1 is inserted into the vertical slot 43 of a partition 29 so that a vertical channel, either 19*a* or 19*b* is resting within the vertical slot 43. The protuberances defining that vertical channel straddle the vertical member 31 and restrict lateral movement of the banding relative to the partition 29. Typically, the vertical slot 43 is so formed that the bottom of the slot is vertically distanced from the shelf 33 as at 49 in FIG. 3. As a result the banding does not rest flush with the shelf. The notch 27 in the horizontal edge of the planar member 3 that is adjacent the surface of the shelf compensates for the offset 49 and allows the banding to rest flush with the shelf. By providing a pair of protuberances on both faces of the planar member and a notch at the top and bottom of the planar member, the banding is rotatable about an imaginary horizontal axis a full 180° without altering the fundamental relationship of the banding with the partition. As described, the banding member extends perpendicularly from the partition in substantially one direction along the edge of a shelf.

Figure 5:
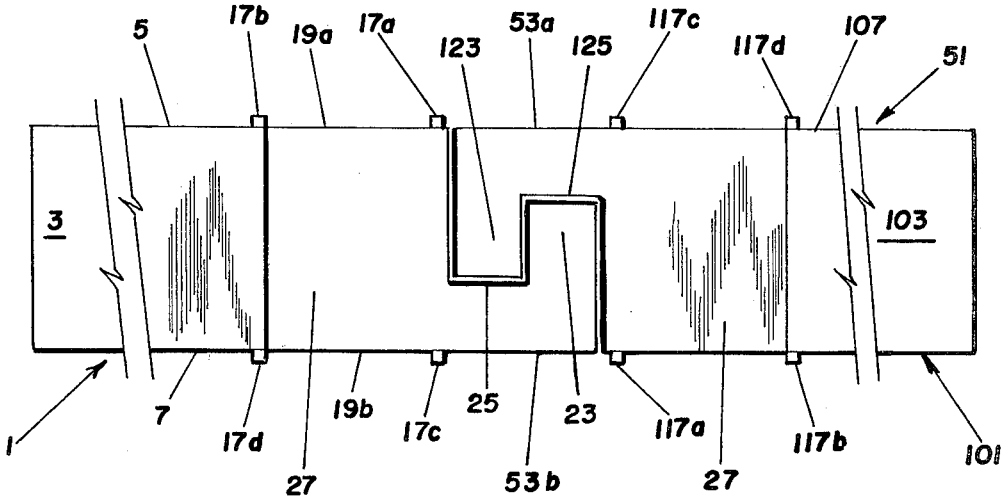
FIG. 5 is plan view of an elongated banding member formed from two banding sections according to this invention.

When a partition separate two display areas and it is desirable to provide partial banding extending perpendicularly in both direction from the partition, the banding member of the instant invention can be so utilized. This manner of banding is shown in use with the center partition C in FIG. 4. Turning now to FIG. 5, two banding members 1 and 101 of similar configuration are joined together to form an elongated member 51.

To effect this joining, the individual banding members are positioned with the first vertical edge of one banding member facing the first vertical edge of the second banding member. The banding members are rotated about their horizontal axes as needed to position the banding members 180° out of phase relative to each other. The tongue 23 of the planar member 3 engages the groove 125 of the planar member 103 while the groove 25 of the planar member 3 receives the tongue 123 of the planar member 103. Thus the first face 5 of the planar member 3 and the second face 107 of the planar member 103 form a continuous planar surface on the elongated member 41 that is only interrupted by protuberances, 17*b*, 17*a*, 117*c* and 117*d*. Likewise, a planar surface is formed by faces 7 and 105. The tongue and groove joining means are so constructed that when two banding members are mated as described above, a channel 53*a* is formed by the protuberances 17*a* and 117*c* on one side of the elongated member and a channel 53*b* is formed by the protuberances 17*c* and 117*a* on the other side of the elongated member 51. The channels 53*a* and 53*b* function in combination with their associated protuberances in the same manner as the channels 19*a* and 19*b*. When inserted into the slot 43 of a vertical member 29, the protuberances defining either channel 53*a* and 53*b* will straddle the vertical member and restrict lateral movement of the elongated banding member. The notches along the horizontal edges of each banding member permit the elongated member to rest flush with the shelf. The arm 41 of the illustrated partition 29 holds the mated banding members in a secure relationship.

Because protuberances are located on both sides of the planar members 3 and 103, the elongated member 51 can be rotated both vertically and horizontally a full 180° and yet to be in a suitable position for insertion into the slot of a vertical member.

What has been described is a banding member for the partial banding of a display shelf. The banding member can be used alone as either a right or left handed banding member extending in substantially one direction from a vertical support member. Two banding members can be mated to form an elongated member which when inserted into a support member extends perpendicularly in two directions therefrom.

What is claimed is:

1. A banding member for use as partial banding along an edge of a display shelf in combination with a vertical planar member serving as a partition on said shelf, said vertical planar member having a vertical mounting slot therein adjacent the display shelf edge for receiving and supporting said banding member therein in an essentially perpendicular relationship with said vertical planar member, said banding member comprising: two interchangeable planar members of essentially similar configuration each having first and second faces, first and second vertical edges, first and second horizontal edges, a tongue extending along the first vertical edge and projecting in the direction of, but terminating short of, the plane of the first face, said tongue defining a vertical groove spaced from the first vertical edge, said tongues and grooves on said planar members being of such dimensions that with the tongue of each planar member engaging the groove of the other planar member an elongated banding member is formed with the first face of each planar member and the second face of the other planar member forming continuous planar surfaces, and means on each face of each planar member adjacent the first edge which forms together with similar means on the other planar member, a vertical channel dimensioned to straddle the vertical planar member and prevent lateral movement of the banding member with respect thereto as the elongated planar member is inserted into said vertical mounting slot and extends in both directions from the vertical member along said edge of the display shelf.

2. The banding member of claim 1 for use with a vertical planar member in which said vertical mounting slot terminates a preset distance above the display shelf, wherein said first horizontal edge of each planar member has a notch extending from said first vertical edge through the vertical channel and said second horizontal edge has a similar notch extending from said first vertical edge through said channel, said notches extending from said first and second horizontal edges respectively at least said preset distance so that when said elongated planar member is inserted into said vertical mounting slot with either horizontal edge down said notches allow said banding member to rest flush with said display itself.

3. The banding member of claim 2 wherein said means for forming said vertical channels comprise a first protuberance protruding from the first and second face of each planar member spaced from the first vertical edge.

4. The banding member of claim 3 including a second protuberance protruding from the first and second face of each planar member spaced from the first protuberance in the direction of the second vertical edge to form with the first protuberance a second vertical channel dimensioned to engage the vertical mounting slot in said vertical planar member from either end of said second channel such that each one of said planar members can be separately, individually mounted through engagement of the second channels with the vertical mounting slot selectively with the first horizontal edge facing downward to extend in a first direction from the vertical planar member along the edge of the display shelf and with the second horizontal edge facing downward to extend in the opposite direction along the shelf edge.

* * * * *